United States Patent [19]

Rabas

[11] 4,386,583

[45] Jun. 7, 1983

[54] MOISTURE SEPARATOR REHEATER APPARATUS

[75] Inventor: Thomas J. Rabas, Broomall, Pa.

[73] Assignee: Westinghouse Electric Corp., Pittsburgh, Pa.

[21] Appl. No.: 318,507

[22] Filed: Nov. 5, 1981

Related U.S. Application Data

[63] Continuation of Ser. No. 156,139, Jun. 3, 1980, abandoned, which is a continuation of Ser. No. 12,917, Feb. 16, 1979, abandoned, which is a continuation of Ser. No. 836,113, Sep. 23, 1977, abandoned.

[51] Int. Cl.[3] ..... F22G 1/00

[52] U.S. Cl. ..... 122/483; 122/33

[58] Field of Search ..... 122/483, 32–34

[56] References Cited

U.S. PATENT DOCUMENTS

| | | | |
|---|---|---|---|
| 3,713,278 | 1/1973 | Miller et al. | 122/483 |
| 3,923,009 | 12/1975 | Sohma | 122/483 |
| 3,996,897 | 12/1976 | Herzog | 122/483 |
| 4,015,562 | 4/1977 | Yousoufian | 122/483 |
| 4,170,115 | 10/1979 | Ooka et al. | 122/33 |

*Primary Examiner*—Henry C. Yuen

*Attorney, Agent, or Firm*—F. J. Baehr, Jr.

[57] ABSTRACT

A moisture separator reheater apparatus having a shell member and a plurality of tube members situated therein with the shell member having a plurality of cycle steam inlets and a plurality of cycle steam outlets disposed on opposite sidewalls. The tube members are disposed longitudinally in the shell member and include an inlet pass and an outlet pass with the inlet pass receiving a heating fluid on its interior while being exposed to cool cycle steam on its exterior. The outlet pass is situated between the inlet pass and the cycle steam outlets, with the outlet pass receiving on its interior heating fluid which has previously flowed through the inlet pass while being exposed to heated cycle steam from the inlet pass on its exterior. All inlet passes receive heating fluid from a common source. A distributing manifold may be disposed within the shell adjacent the cycle steam inlets for distributing entering cycle steam transversely and longitudinally within the shell to a moisture separator structure which is situated between the distributing manifold and the inlet passes. The cycle steam may be heated in a plurality of stages by connecting the cycle steam outlets of one shell with the cycle steam inlets of a different shell and providing the inlet passes of each succeeding shell downstream from the first shell with heating fluid of increasing temperature.

1 Claim, 4 Drawing Figures

MOISTURE SEPARATOR REHEATER APPARATUS

This application is a continuation of Ser. No. 156,139, filed June 3, 1980, which is a continuation of Ser. No. 12,917, filed Feb. 16, 1979 and which is a continuation of Ser. No. 836,113, filed Sept. 23, 1977 all of which are abandoned.

BACKGROUND OF THE INVENTION

1. Field of the Invention

This invention relates to moisture separator reheaters, and more particularly, to the relative shell side and tube side fluid flow directions and relative placement of steam reheating means.

2. Description of the Prior Art

Light water nuclear reactors generally produce saturated or only slightly superheated steam of relatively low pressure. During the process of expanding steam in a steam turbine and extracting mechanical energy therefrom, the moisture percentage in the steam increases as it passes through the steam turbine. For most fossil fueled power cycles moisture forms only in the relatively late turbine stages in the vicinity of the turbine exhaust since fossil fueled power cycles generally utilize throttle steam of relatively high pressure and significant superheat. Turbines used in conjunction with nuclear fueled power cycles experience substantial moisture formation in many of the turbine stages due to the relatively low pressure, saturated throttle condition for the steam. Such moisture in nuclear steam turbines can impair the efficiency of turbine blades subjected to it and cause them to erode at excessive rates. For such reasons, it is highly desirable to remove the moisture from the moist steam before further expansion of that steam through the turbine. Furthermore, it has been found that reheating the steam after its separation from the moisture provides further increases in the efficiency of the power cycle.

It has been common practice to combine moisture separators with steam reheaters in a single shell member. A further common practice has been to provide stages of reheat in series flow relation across the path of the relatively cool cycle steam. Such staging has often been accomplished by providing separate tube bundles each of which is supplied with a different steam temperature with the steam temperatures increasing in the direction of cycle steam flow. Such low and high pressure reheating tube bundles have been disposed in both the horizontal and vertical series flow positions, but both dispositions have commonly utilized reheater inlet pass tubes arranged vertically over reheater outlet pass tubes in fluid communication therewith. Prior art has commonly utilized cycle steam inlets on the end of and cycle steam outlets on the top of the shell enclosure member. Also known in the prior art is the use of disposing cycle steam inlets on one sidewall of the shell member and situating cycle steam outlets on an opposite side of the shell member. Such a scheme is disclosed by U.S. Pat. No. 3,923,009, issued Dec. 2, 1975. That invention's horizontal disposal of the cycle steam inlets and outlets drastically reduced the shell side pressure loss and provided a simultaneous increase in the cycle efficiency over those cycles which previously utilized moisture separator reheaters having cycle steam inlets disposed on the moisture separator reheater's ends.

A problem encountered in prior art moisture separator reheaters included of the heating fluid subcooling on the interior of the reheater tubes. Such subcooling was caused by relatively cold cycle inlet steam contacting the exterior of the heating fluid's tubes in the outlet or other secondary pass. At some point within the outlet or secondary pass tubes, heating fluid therein was entirely condensed and any further heating of the cycle steam contacting the tube's exterior had to originate from subcooling the already condensed heating fluid flowing therein. Such subcooling caused the inlet and outlet pass fluid heating tubes to have different tube temperatures, resulting in differential thermal expansion therebetween. Such differential thermal expansion resulted in high weld stresses and caused tube binding when U tubes were used. The previously mentioned patent does not reduce the magnitude of such subcooling since the exterior of the outlet or other secondary pass fluid heating tubes are still subjected to the coldest cycle steam in the moisture separator reheater. Such temperature difference tends to extract additional heat from the heating fluid which, when all has been condensed, must be subcooled below its condensing temperature. To combat the subcooling problem, the prior art has utilized such schemes as orifice plates on radially inner inlet pass tubes to force greater portions of heating fluid into the radially outer inlet pass tubes which are in fluid communication with the radially outer outlet pass fluid heating tubes. The use of such orifice plates, however, has disadvantages in the cost of materials, cost of assembly within the moisture separator reheater unit, and increased tube side pressure drop.

Interceptor valves are commonly located on the cycle steam outlets of moisture separator reheaters and are periodically tested by opening and closing. On previous "end" cycle steam inlet designs shell erosion and tube vibration were problems during interceptor valve testing since, in some cases, twice the maximum rated cycle steam flow passed through the shell and across the tube bundles. With the present invention, however, the full shell length and cross-section are available for steam flow with the steam flow through the optional separators and across the tube bundles being nearly the same as that existent during full load flow.

On previous designs the low pressure and high pressure tube bundles were assembled in series flow relation on their shell side. When it became necessary to remove one or more of the low pressure tube bundles from service, the steam whch was normally heated by that bundle would pass through without any heating and be mixed with the balance of the steam which was heated. Such failure to reheat a portion of the cycle steam can have a substantial effect on cycle efficiency.

A further disadvantage of the end inlet, top outlet design is that the piping required thereby and the piping required by many of the new side entry turbines are not compatible.

As can be seen, most prior art problems stem directly from one or more of the following steam reheater characteristics: cycle steam end inlet-top outlet configuration, series flow relation between low pressure-high pressure tube bundle within the same shell member, and the vertical tube side traverse of the heating fluid in such manner that the outlet pass tubes on each bundle are exposed on their shell side to the coolest cycle steam within the moisture separator reheater unit.

SUMMARY OF THE INVENTION

In accordance with the present invention, an improved moisture separator reheater is provided which reduces shell side pressure drop, reduces the magnitude of condensate subcooling, decreases tube side pressure drop, reduces tube vibration and internal shell erosion during interceptor valve testing, reduces large approach temperature differences for high pressure tube bundles when selected low pressure tube bundles are removed from service, and has piping connections which are compatible with many of the new side entry turbines. The invention generally comprises an enclosed shell member, a plurality of cycle steam inlets and cycle steam outlets arranged on substantially opposite sidewalls of the shell member, means for reheating the cycle steam as it passes through the shell member between the cycle steam inlets and cycle steam outlets, with the reheating means including a plurality of heat exchange tubes having a portion of inlet pass tubes and a portion of outlet pass tubes with fluid communication being provided therebetween. The shell side of the inlet pass tubes is disposed nearer the cycle steam inlets than is the shell side of the outlet pass tubes. Moisture separating means and steam distributing means may be provided in the shell member for removing excess moisture from and uniformly distributing cycle steam across the shell member when the cycle inlet steam is of high moisture, low quality content. Each shell member is to have heating fluid tubes and bundles assembled therefrom which receive heating fluid from a common source. Each shell then provides a single stage of heating for the cycle steam. The shells of different heating stages are connected between their cycle steam inlets and outlets to provide a multiple stage heating of the cycle steam.

BRIEF DESCRIPTION OF THE DRAWINGS

The invention will be more fully understood from the following detailed description of a preferred embodiment, taken in connection with the accompanying drawings, in which.

DESCRIPTION OF THE PREFERRED EMBODIMENT

Figure 1:
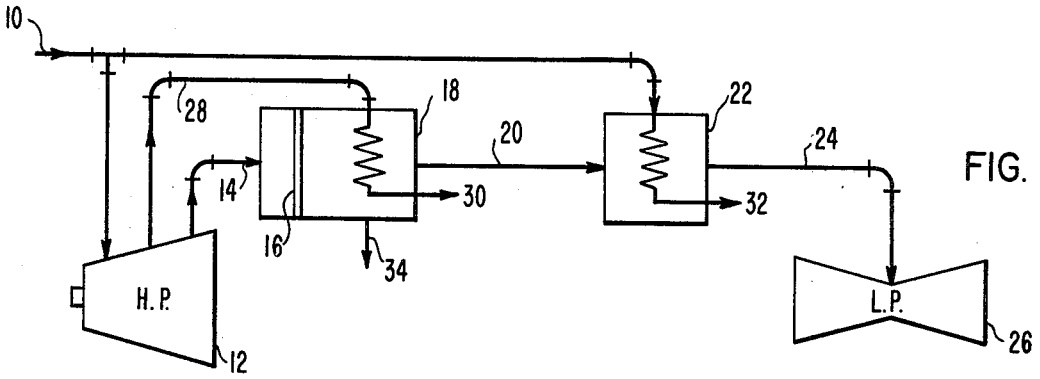
FIG. 1 is a schematic representation of a portion of a steam power plant system utilizing the present invention.

The present invention is to be utilized in a nuclear power plant system which is schematized in FIG. 1. In such a steam power plant system, steam from a reactor or intermediate steam generator (neither of which is shown) is provided in a nearly saturated vapor condition through conduit 10 to high pressure turbine 12. Moisture laden steam exhausts from high pressure turbine 12 through conduit 14. The moisture laden steam is initially passed through separator 16 where the moisture is removed and then through low pressure reheater structure 18, through intermediate conduit 20, and finally through steam conduit 24 for delivery to low pressure turbine 26. Reheater structures 18 and 22 superheat the dry steam on its way to low pressure turbine 26. Illustrated steam heating sources include extraction conduit 28 which provides partially expanded steam from high pressure turbine 12 to reheater 18 while a portion of the throttle steam supplied through conduit 10 is diverted to second stage reheater 22. Heating steam for reheaters 18 and 22 is respectively removed therefrom in the form of moist steam or condensate through drains 30 and 32. Small additional quantities of steam are removed through vent lines (not shown) whose primary purpose is to expel non-condensible substances from the interior of the reheaters. Moisture removed by separator 16 is drained away through conduit 34. The schematic of FIG. 1 is intended to only convey one way in which the present invention may be utilized in a power cycle. It is to be understood that steam sources, number of turbines, and number of reheats may vary from the specific embodiment illustrated.

Figure 2:
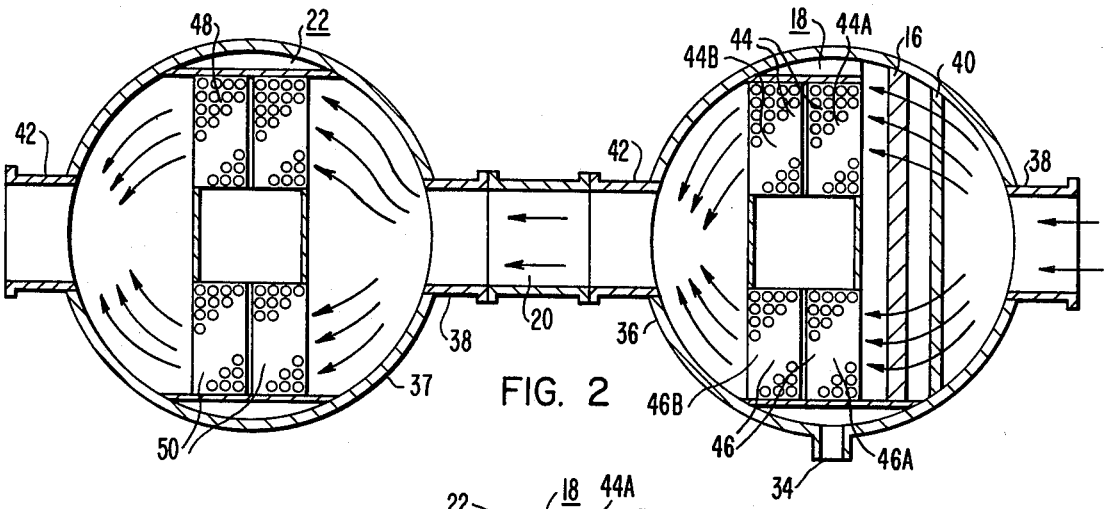
FIG. 2 is a section view of a low pressure and a high pressure steam reheater apparatus connected in series with the low pressure apparatus also having a steam distributing and moisture separator portion.

FIG. 2 is a transverse section view of the present invention illustrating two stages of steam reheat. Moisture laden steam from conduit 14 enters shell 36 through a plurality of steam inlets 38, better illustrated in FIG. 3. The moisture laden steam, upon entering shell 36, is transversely and longitudinally distributed across the shell interior by distributing manifold 40, which may be a perforated plate, slotted plate, or other device which will uniformly disperse the steam and deliver it to separating device 16, which is most commonly a series of vertical chevron vanes. Moisture removed by separating device 16 is drained through drain outlet 34.

The cycle steam, then in a dry state, passes through reheater 18 where heat energy is added before exiting shell 36 through a plurality of cycle steam outlets 42 and into intermediate conduit 20. Reheater 18 appears in FIG. 2 to have two tube bundles 44 and 46, but may have any suitable number, such as the four tube bundles illustrated in FIG. 3. Tube bundle 44 includes inlet pass **44*a* and outlet pass 44*b*, while bundle 46 includes inlet pass 46*a* and outlet pass 46*b*. Although two passes for each tube bundle are indicated, it is to be understood that any number of passes are encompassed by the present invention with the only restriction being that the inlet heating steam flow through passes 44*a* and 46*a* with the exterior of those passes being exposed to cycle steam which is relatively cooler than the cycle steam which contacts the exterior of outlet passes 44*b* and 46*b*. Such requirement prevents tube binding, precludes condensate subcooling, and the temperature fluctuations which accompany it, reduces shell side pressure drop, obviates the need for orifice plates which are presently used to minimize such subcooling and temperature fluctuations, and avoids the tube side pressure drop associated with such orifice plates. It is common practice to use U tubes in moisture separator reheaters with the present invention's embodiment having each U tube existent in a horizontal, rather than a vertical plane. Thus, each U tube has an inlet leg in pass 44*a* or 46*a* and an outlet leg in pass 44*b* or 46*b*. By disposing the tube passes in such relative configuration, the temperature difference between the heating steam in the outlet pass and the cycle steam on the shell side of such outlet pass is minimized, reducing or eliminating subcooling of the condensate. While U tubes are preferred, it is to be understood that reversing water chambers or other devices may be used to route partially condensed and cooled heating steam into outlet passes 44*b* and 46*b* from inlet passes 44*a* and 46*a***, respectively.

The dry and once reheated steam flows through conduits 20 and into a second stage reheater 22 through a plurality of cycle steam inlets 38. Second stage reheater 22 has tube bundles 48 and 50 which are of similar construction to tube bundles 44 and 46. Shell 37 for reheater 22 is seen not to house distributing manifold 40 or separating device 16 since the cycle steam entering is dry and often superheated and thus does not require moisture separation and uniform steam distribution to such moisture separator. After passing through the second stage reheater 22, the low pressure cycle steam exits a plurality of outlets 42 in a further superheated condition. Although only two tube bundles are illustrated in reheater 22, no restriction on the number thereof is intended, and no minimum number is implied.

Figure 3:
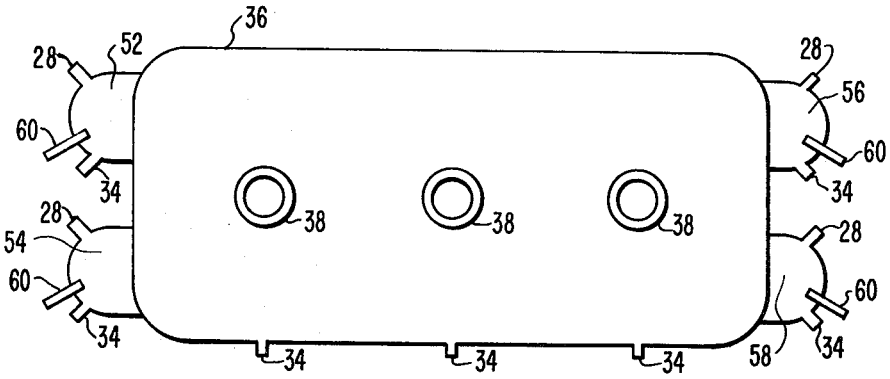
FIG. 3 illustrates an elevation view along one side of either apparatus shown in FIG. 2.

FIG. 3 illustrates an elevation view of a low pressure shell 36 which may be distinguished from a high pressure shell 37 by the presence of moisture drain outlets 34. A plurality of cycle steam inlets 38 are illustrated with the cycle steam outlets 42 being hidden on the opposite side therefrom. Heating steam supply headers 52, 54, 56, and 58 are illustrated as being attached to shell 36. Each heating steam supply header has attached thereto heating steam supply conduit 28 and condensate drain conduit 30 for transferring therethrough condensate resulting from heating steam condensation on the interior of the tubes in reheater bundles 44 and 46. Each supply header services one tube bundle having a reversing chamber or, in the alternative, U tubes on the end of the bundle hidden from view on the interior of shell 36. Vents 60 are also attached to each supply header for removing noncondensables from the interiors thereof. The steam supply headers are divided into at least two portions. The first portion directs heating steam from heating steam conduits 28 into one tube bundle's inlet pass tubes, such as pass 44*a*. The other portion provides fluid communication between the outlet pass of a tube bundle to a condensate outlet conduit, through which the liquid resulting from its condensation is drained. It is to be noted that while inlet heating steam conduit 28 and condensate outlet 34 appear in FIG. 3 to be on the header's centerline, they may be disposed in any manner to cooperate with the dividing portion to respectively provide steam flow to and condensate removal from the inlet and outlet passes, respectively, such as 44*a* and 44*b*.

Figure 4:
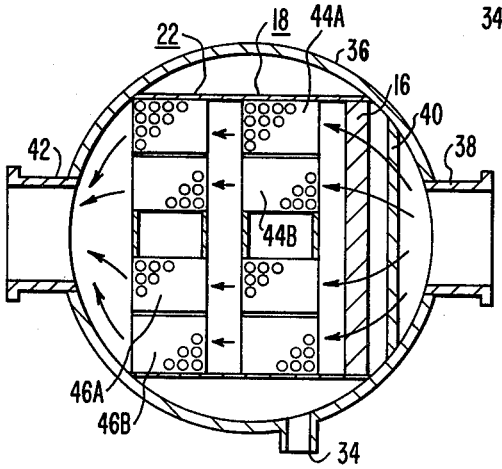
FIG. 4 is a transverse cross-sectional view of a prior art apparatus.

FIG. 4 illustrates a prior art apparatus having a plurality of cycle steam inlets 38, cycle steam outlets 42, shell 36, moisture drains 34, and first and second stage reheaters 18 and 22, respectively. It is to be noted that both stages of reheating are done within the same shell member 36 and the inlet and outlet tube bundle passes are vertically oriented, one above the other, such as inlet passes 44*a* and 46*a* being respectively disposed above outlet passes 44*b* and 46*b*. Arranging both stages of reheat within the same shell member causes large temperature differences and excessive pressure drops in the tube side of high pressure tube bundles in reheating section 22 when the corresponding low pressure tube bundles within reheating section 18 are removed from service. By separating the reheating sections into their respective shells, temperature variation between the high pressure tube bundles and the cycle steam passing over their exterior was minimized by virtue of the fact that the low pressure tube bundles remaining in service provide some heating for the steam passing over them and the heated cycle steam mixes with the cycle steam passing over the out-of-service low pressure tube bundles prior to entering the high pressure tube bundles. Additionally, subcooling of the condensing heating fluid and tube binding resulting therefrom are eliminated by the present invention's horizontal "U-shape" path. The heating steam inlet pass 44*a* and outlet pass 44*b* of the prior art configuration in FIG. 4 were exposed, on their shell side, to substantially the same cycle steam temperature, causing substantial subcooling along the tube bundle's margin adjacent separator 16 of outlet pass 44*b* and 46*b*. Such subcooling resulted from continual heat transfer from the tubes adjacent the separating device after the heating fluid passing through those tubes had condensed. Such heat transfer occurred because the outlet pass, such as 44*b*, continued to be subjected to relatively cold cycle steam on its exterior, causing further heat transfer from the already condensed heating fluid to result in a decrease in its temperature.

It will now be apparent that an improved moisture separator reheater apparatus and staging system therefor has been provided in which subcooling of the reheater tube side fluid has been reduced while tube binding and fatiguing of the tube welds resulting therefrom have been substantially eliminated, with the further advantages of increased moisture separator reheater performance and higher reliability assurance for operating at off-design conditions.

I claim:

1. A steam reheating apparatus comprising:

a first enclosed shell member;

a plurality of first cycle steam inlets arranged on one sidewall of said first shell;

a plurality of first cycle steam outlets arranged on an other sidewall of said first shell, said other sidewall being substantially oppositely situated from said one sidewall;

first means for reheating said cycle steam, said first reheating means extending longitudinally in said first shell between said first cycle steam inlets and said first cycle steam outlets;

a second shell member;

a plurality of second cycle steam inlets arranged on one sidewall of said shell, and disposed in fluid communication with said first steam cycle outlets in a series flow relation;

a plurality of second cycle steam outlets arranged on an other sidewall of said second shell, said other sidewall being substantially oppositely situated from said one sidewall;

second means for reheating said cycle steam, said second reheating means extending longitudinally in said second shell between said second cycle steam inlets and said second cycle steam outlets;

said first and second reheating means each including a plurality of heat exchange tubes grouped in a plurality of fluidly communicating tube passes wherein all successive tubeside fluid communicating passes are successively downstream from said respective cycle steam inlets, said tube passes including inlet and outlet passes in each shell, all said inlet pass tubes being in fluid communication with a heating fluid;

means for separating moisture from said cycle steam, said moisture separating means being disposed in said first enclosed shell between said first cycle steam inlets and said first reheating means; and means for distributing cycle steam to said moisture separating means, said distributing means being disposed in said first enclosed shell between said moisture separating means and said first cycle steam inlets;

said tube passes being grouped in a plurality of tube bundles, each of which have an inlet in fluid communication with a source of heating fluid, the shell side of said bundles being in parallel flow relation with the fluid in said tubes to eliminate subcooling within said tubes.

* * * * *